US009361850B2

(12) United States Patent
Woo et al.

(10) Patent No.: US 9,361,850 B2
(45) Date of Patent: Jun. 7, 2016

(54) DISPLAY DEVICE

(71) Applicant: LG Display Co., Ltd., Seoul (KR)

(72) Inventors: Jung-Hoon Woo, Siheung-si (KR); Young-Ho Kim, Gyeongsangbuk-do (KR); Min-Ki Kim, Gyeongsangbuk-do (KR); Hwan-Joo Lee, Daegu (KR)

(73) Assignee: LG DISPLAY CO., LTD., Seoul (KR)

( * ) Notice: Subject to any disclaimer, the term of this patent is extended or adjusted under 35 U.S.C. 154(b) by 27 days.

(21) Appl. No.: 14/509,791

(22) Filed: Oct. 8, 2014

(65) Prior Publication Data

US 2015/0103067 A1 Apr. 16, 2015

(30) Foreign Application Priority Data

Oct. 10, 2013 (KR) ..... 10-2013-0120862

(51) Int. Cl.
*G09G 3/36* (2006.01)

(52) U.S. Cl.
CPC ..... *G09G 3/3696* (2013.01); *G09G 3/3655* (2013.01); *G09G 3/3666* (2013.01); *G09G 2320/0252* (2013.01); *G09G 2320/0271* (2013.01)

(58) Field of Classification Search
CPC ..... G09G 3/3655; G09G 2320/0252; G09G 2320/0271; G09G 3/3666
See application file for complete search history.

(56) References Cited

U.S. PATENT DOCUMENTS 5,841,410 A * 11/1998 Oda ..... G09G 3/3648 345/58
2008/0024417 A1* 1/2008 Huang ..... G09G 3/3614 345/98
2012/0162184 A1* 6/2012 Kim ..... G09G 3/3655 345/212
2012/0293560 A1* 11/2012 Li ..... G09G 3/3607 345/690
2014/0085345 A1* 3/2014 Ma ..... G09G 3/3614 345/690

* cited by examiner

*Primary Examiner* — Ilana Spar
*Assistant Examiner* — Mihir Rayan
(74) *Attorney, Agent, or Firm* — Fenwick & West LLP

(57) ABSTRACT

A display device includes a panel displaying an image using image data and including a common electrode to which a common voltage is applied; a timing controller providing the image data to the panel and outputting a correction voltage corresponding to the image data; and a power supply unit generating a compensation voltage using a panel common voltage and the correction voltage and providing the compensation voltage to the panel, wherein the panel common voltage is a voltage measuring the common voltage applied to the panel.

7 Claims, 5 Drawing Sheets

DISPLAY DEVICE

CROSS-REFERENCE TO RELATED APPLICATION

This application claims the priority benefit of Korean Patent Application No. 10-2013-0120862, filed in the Republic of Korea on Oct. 10, 2013, which is hereby incorporated by reference in its entirety.

BACKGROUND OF THE INVENTION

1. Field of the Invention

The present disclosure relates to a display device, and more particularly, to a display device including a power supply unit that provides a compensation voltage.

2. Discussion of the Related Art

A liquid crystal display device displays an image by driving thin film transistors, formed on a substrate, according to input of image data.

The liquid crystal display device includes liquid crystal capacitors and storage capacitors, and displays an image by receiving voltages from a data driver and maintaining the voltages.

When the voltages having a predetermined polarity are continuously supplied, a common voltage is shifted in pixels of a panel of the liquid crystal display device. There is a smearing phenomenon on a screen, and thus the quality of the image is lowered. To prevent this, a compensation voltage for compensating the common voltage may be provided to the panel, which will be described hereinafter with reference to FIG. 1.

FIG. 1 is a circuit diagram of an exemplary display device according to the related art.

In FIG. 1, the display device according to the related art includes a panel 10 and a power supply unit 20.

The power supply unit 20 includes an operational amplifier 22, a common voltage supply section 23, a first capacitor C1, a first resistor R1 and a second resistor R2. An output (O) of the operational amplifier 22 is connected to the panel 10, and a non-inverting input (+) of the operational amplifier 22 is connected to the common voltage supply section 23. The first capacitor C1 and the first resistor R1 are connected between the panel 10 and an inverting input (−) of the operational amplifier 22 in series. The second resistor R2 is connected between the output (O) and the inverting input (−) of the operational amplifier 22.

A gate driver 15 and a data driver 16 are connected to the panel 10.

In the display device according to the related art, feedback is performed by transferring a panel common voltage PVcom through a circuit path between the panel 10 and the inverting input (−) of the operational amplifier 22, and a compensation voltage Vi generated according to the feedback performance is provided to panel 10.

The operational amplifier 22 outputting the compensation voltage Vi has a fixed compensation rate in order to reduce oscillations that may occur during the feedback performance. In this case, it is hard to perform compensation for each location and each size because of a common voltage shift, which non-linearly increases as time passes.

In addition, the display device according to the related art generates the compensation voltage Vi based on the panel common voltage PVcom. Namely, since the panel common voltage PVcom is measured and the compensation voltage Vi to the measured common voltage is outputted for the feedback, a shift to the panel common voltage may have occurred. Thus, the compensation voltage Vi is not applied at an appropriate timing.

Therefore, the panel 10 cannot suitably receive the compensation voltage Vi and cannot normally display an image. This will be described hereinafter with reference to FIG. 2.

FIG. 2 is a view of illustrating an upper portion and a lower portion of a photograph of an image displayed by a display device according to the related art.

As shown in FIG. 2, in the upper portion of the display device according to the related art, although the compensation voltage is applied, the common voltage shift occurring in the panel is not compensated, and thus patterns having a lattice shape are shown in an area A of the panel.

In the lower portion of the display device, the common voltage and the compensation voltage accord with each other as compared with the upper portion, and patterns like the upper portion are hardly shown.

This is why the common voltage shifts differ in the upper and lower portions. Thus, when the same compensation voltage is applied to the panel, the common voltage shift is sufficiently compensated in the lower portion while the common voltage shift is not sufficiently compensated in the upper portion.

Accordingly, in the display device according to the related art to which the compensation voltage having the same magnitude as the common voltage shift, the image quality is lowered. Additionally, since reproducibility and visibility differ in the upper and lower portions of the panel, the image quality of the display device is not uniform.

SUMMARY OF THE INVENTION

Accordingly, the invention is directed to a display device that reduces one or more of the problems due to limitations and disadvantages of the related art.

An object of the invention is to provide a display device that increases the image quality and provides a uniform image.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the invention, as embodied and broadly described, a display device includes a panel displaying an image using image data and including a common electrode to which a common voltage is applied; a timing controller providing the image data to the panel and outputting a correction voltage corresponding to the image data; and a power supply unit generating a compensation voltage using a panel common voltage and the correction voltage and providing the compensation voltage to the panel, wherein the panel common voltage is a voltage measuring the common voltage applied to the panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Reference will now be made in detail to an embodiment of the invention, an example of which is illustrated in the accompanying drawings.

Figure 3:
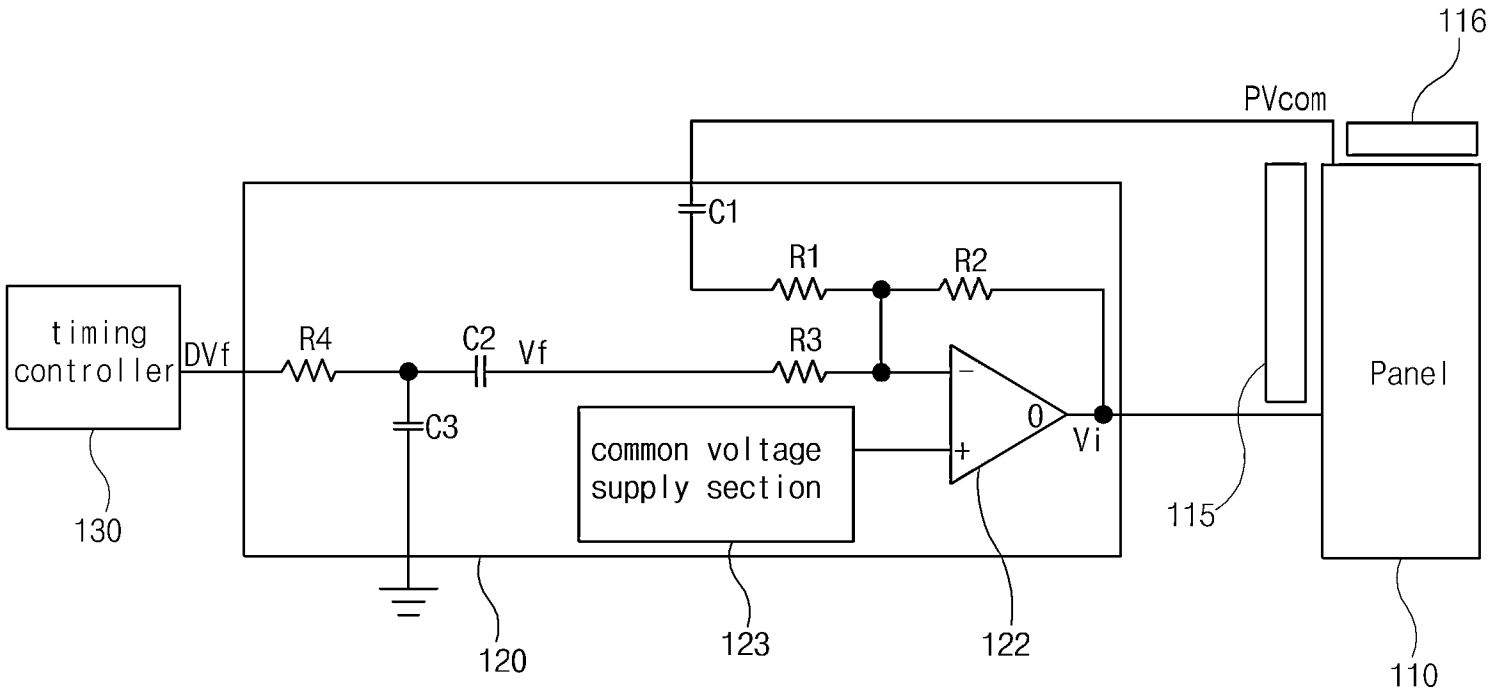
FIG. 3 is a circuit diagram of a display device according to an embodiment of the invention.

FIG. 3 is a circuit diagram of a display device according to an embodiment of the invention.

In FIG. 3, the display device according to the embodiment of the invention includes a panel 110, a power supply unit 120 and a timing controller 130.

The panel 110 includes a first substrate, a second substrate and a liquid crystal layer between the first and second substrates. Gate and data lines, thin film transistors and pixel electrodes are formed on the first substrate, and a black matrix and color filters are formed on the second substrate. A gate driver 115 and a data driver 116 are connected to the panel 110.

A common electrode may be formed on a substantially entire surface of the second substrate or may be formed at each pixel region on the first substrate with a bar shape.

The common electrode receives a common voltage. A polarity of the common voltage may be reversed every period to prevent charge accumulation.

The power supply unit 120 includes an operational amplifier 122, a common voltage supply section 123, first, second, third and fourth resistors R1, R2, R3 and R4, and first, second and third capacitors C1, C2 and C3.

The operational amplifier 122 includes an inverting input (−), a non-inverting input (+) and an output (O). The inverting input (−) of the operational amplifier 122 receives a panel common voltage PVcom from the panel 110 and a correction voltage Vf from the timing controller 130. The non-inverting input (+) receives a reference common voltage from the common voltage supply section 123. The output (O) outputs a compensation voltage Vi.

The first capacitor C1 and the first resistor R1 are connected between the panel 110 and the inverting input (−) in series, and the fourth resistor R4, the second capacitor C2 and the third resistor R3 are connected between the inverting input (−) and the timing controller 130.

One terminal of the third capacitor C3 is connected between the fourth resistor R4 and the second capacitor C2, and a second terminal of the third capacitor C3 is connected to ground. The fourth resistor R4 and the third capacitor C3 form a low pass filter between timing controller 130 and the second capacitor C2. The second resistor R2 is connected between the inverting Input (−) and the output (O).

The operational amplifier 122, the first, second and third resistors R1, R2 and R3, and the common voltage supply section 123 may be formed as an integrated circuit (IC).

The timing controller 130 coupled to the operational amplifier 122 provides driving signals to the gate driver 115 and the data driver 116 and also outputs a digital correction voltage DVf to a circuit path connected to the inverting input (−) of the operational amplifier 122. A low pass filter comprising the third capacitor C3 and the fourth resistor R4 is used to apply a correction voltage Vf converted into an analog type to the operational amplifier 122 receiving an analog type voltage.

The low pass filter may be formed as one element, that is, the third capacitor C3 and the fourth resistor R4 may be formed as one united body.

The digital correction voltage DVf generated by the timing controller 130 may be outputted before occurrence of the common voltage shift in the panel 110, and the compensation voltage Vi may be outputted to the panel 110. A process of generating the correction voltage Vf for outputting the compensation voltage Vi will be described with reference to FIG. 4.

Figure 4:
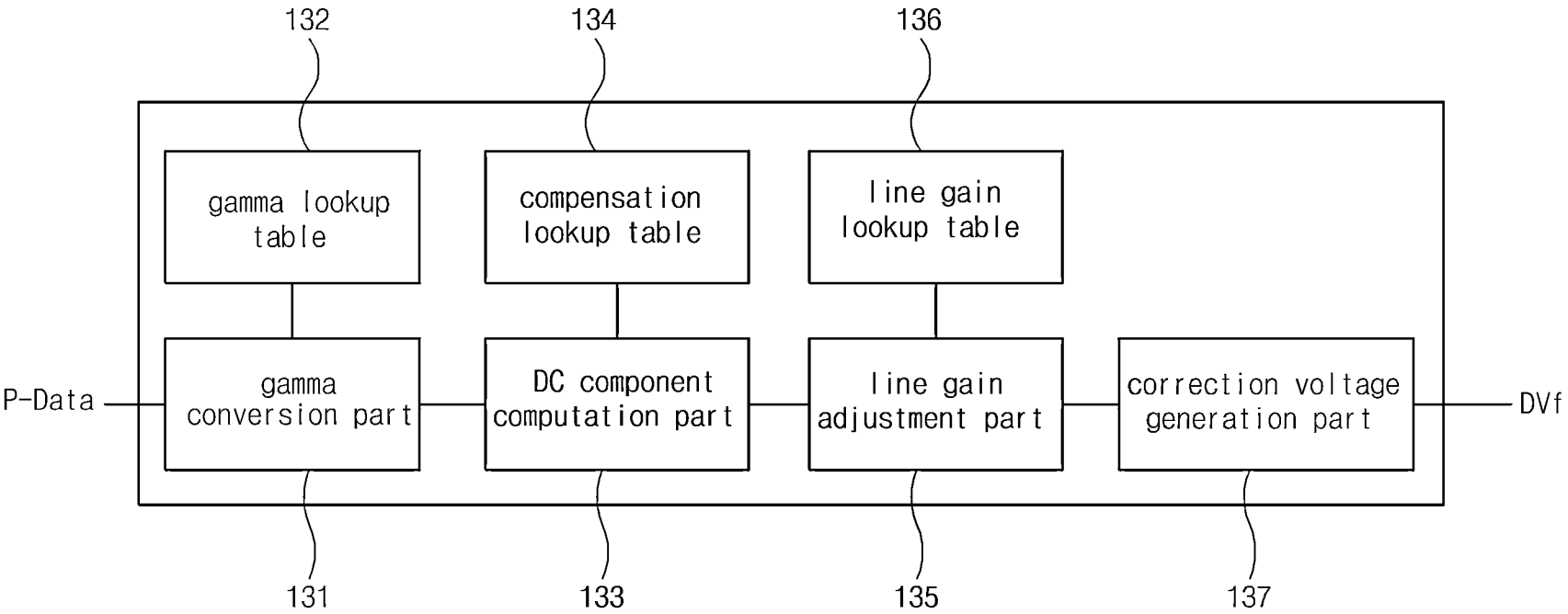
FIG. 4 is a block diagram of a timing controller of a display device according to an embodiment of the invention.

FIG. 4 is a block diagram of a timing controller of a display device according to an embodiment of the invention.

In FIG. 4, the timing controller 130 of the display device according to the embodiment of the invention includes a gamma conversion part 131, a gamma lookup table 132, a DC component computation part 133, a compensation lookup table 134, a line gain adjustment part 135, a line gain lookup table 136, and a correction voltage generation part 137.

The gamma conversion part 131 receives image data P-Data and obtains a gray level value corresponding to the image data P-Data using the gamma lookup table 132.

The obtained gray level value is inputted to the DC component computation part 133 to supply the optimized compensation voltage to each common electrode in the panel 110. DC component computation part 133 obtains a DC component value corresponding to the inputted gray level value using the compensation lookup table 134, and the DC component value is inputted to the line gain adjustment part 135.

The line gain adjustment part 135 obtains a gain value using the line gain lookup table 136 and determines a magnitude of the compensation voltage from the DC component value and the gain value. The magnitude of the compensation voltage is inputted to the correction voltage generation part 137. The correction voltage generation part 137 generates the digital correction voltage DVf from the magnitude of the compensation voltage and outputs the digital correction voltage DVf.

The digital correction voltage DVf is outputted before the common voltage shift occurs in the panel common voltage PVcom of FIG. 3. Therefore, the common voltage shift and the smearing phenomenon due to the voltage shift are lowered in the display device. In addition, the compensation voltage provided to the upper portion of the panel 110 of FIG. 3 increases, and an appropriate compensation is performed, thereby displaying an image of improved uniformity all over the panel 110 of FIG. 3.

The timing controller 130 may include storage parts for providing the gamma lookup table 132, the compensation lookup table 134, and the line gain lookup table 136, respectively. Alternatively, the gamma conversion part 131, the DC component computation part 133, and the line gain adjustment part 135 may include the gamma lookup table 132, the compensation lookup table 134, and the line gain lookup table 136, respectively The timing controller 130 may include a storage part providing the gamma lookup table 132, the compensation lookup table 134, and the line gain lookup table 136.

The digital correction voltage DVf is converted to the analog correction voltage Vf. The analog correction voltage Vf is amplified by the operational amplifier 122 of FIG. 2 and outputted as the compensation voltage Vi. This will be described with reference to FIG. 5.

Figure 5:
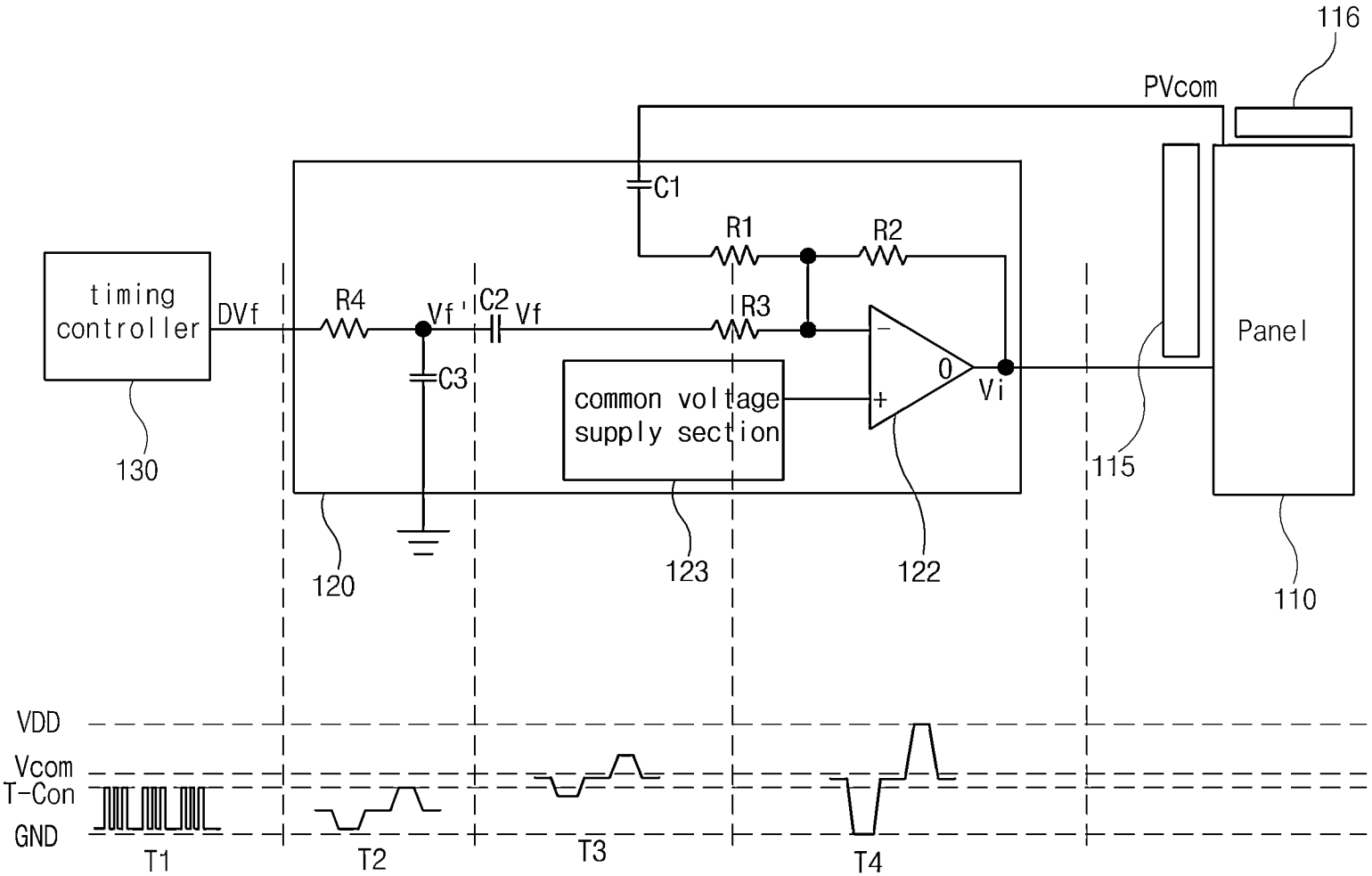
FIG. 5 is a view of a process of generating a compensation voltage applied to a display device according to an embodiment of the invention.

FIG. 5 is a view of a process of generating a compensation voltage applied to a display device according to an embodiment of the invention.

As shown in FIG. 5, in the display device according to one embodiment of the invention, the power supply unit 120 receives the digital correction voltage DVf, converts the digital correction voltage DVf into the correction voltage Vf from the timing controller 130 and outputs the compensation voltage Vi.

First, to output the correction voltage Vf, the timing controller 130 outputs the digital correction voltage DVf having a waveform shown at T1.

Then, the digital correction voltage DVf passes through a low pass filter comprising the fourth resistor R4 and the third capacitor C3, and is converted into a correction voltage Vf having a waveform shown at T2.

The correction voltage Vf passes through the second capacitor C2 and is converted into the correction voltage Vf. Here, the correction voltage Vf has the same shape as the correction voltage Vf and has different voltage levels. Namely, the correction voltage Vf has a voltage level of the timing controller 130, and the correction voltage Vf has a voltage level of the common voltage.

The correction voltage Vf having the converted voltage level is inputted to the inverting input (−) of the operational amplifier 122 through resistor R3.

The operational amplifier 122 receives the correction voltage Vf and the panel common voltage PVcom at its inverting input (−), and amplifies the correction voltage Vf and the panel common voltage PVcom. The operational amplifier 122 generates a waveform shown at T4 and reverses the waveform, thereby outputting the compensation voltage Vi.

The display device outputting the compensation voltage, lowers the reduction in image quality due to overcharge or overdischarge. Moreover, since the more appropriate compensation voltage is outputted according to circumstances, the difference of the image quality between upper and lower portions of the panel 110 of FIG. 3 of the display device is reduced.

Figure 6:
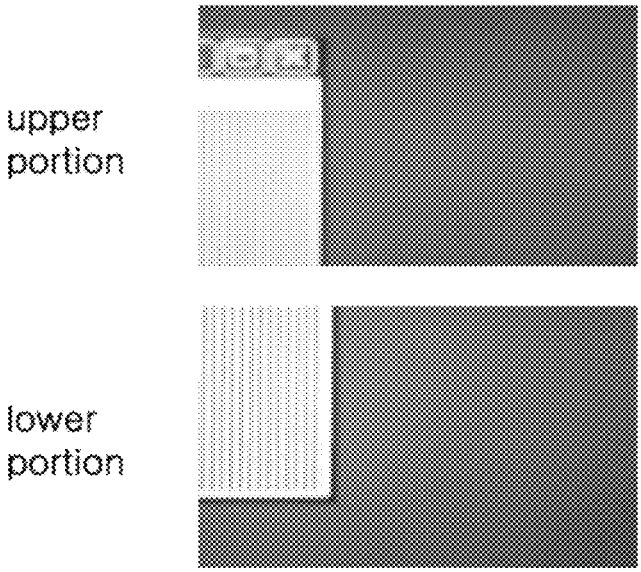
FIG. 6 is a view of an upper portion and a lower portion of a photograph of an image displayed by a display device according to an embodiment of the invention.

FIG. 6 is a view of an upper portion and a lower portion of a photograph of an image displayed by a display device according to an embodiment of the invention.

As shown in FIG. 6, the image displayed in the upper and lower portions of the panel 110 of FIG. 3 has high quality because the overcharge or overdischarge due to the common voltage shift is very low.

Figure 1:
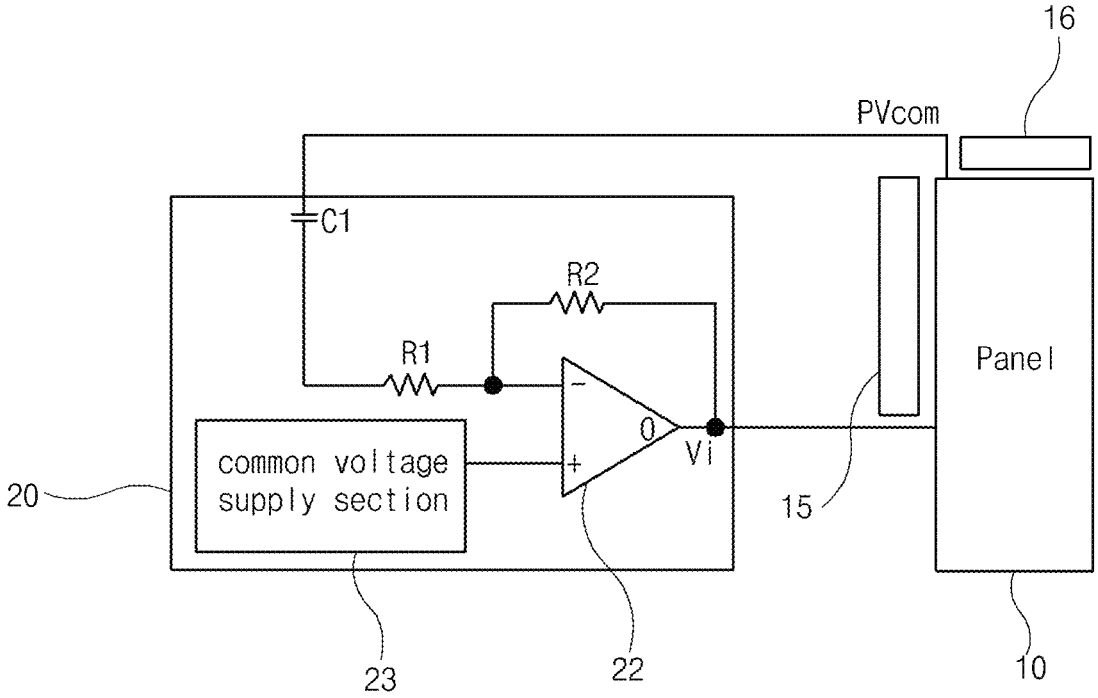
FIG. 1 Related Art
FIG. 1 is a circuit diagram of a display device according to the related art.
Figure 2:
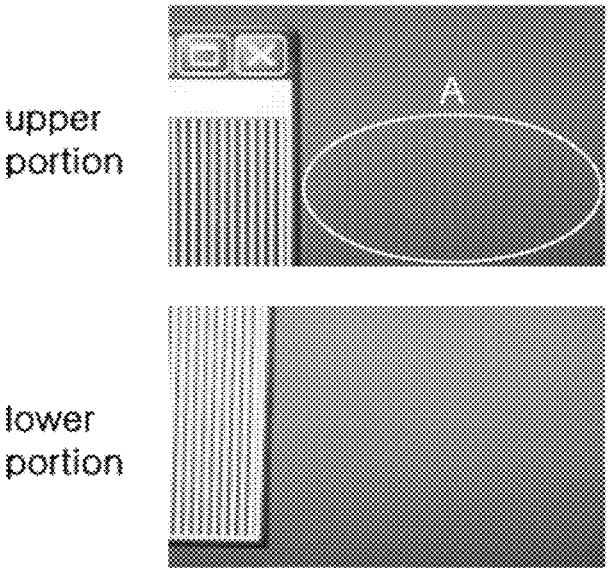
FIG. 2 Related Art
FIG. 2 is a view of an upper portion and a lower portion of a photograph of an image displayed by a display device according to the related art.

The difference between the upper and lower portions in the image of FIG. 6 as compared with the image of FIG. 2 according to the related art is reduced. In addition, there are no patterns, which are shown in the image of the display device according to the related art because of the common voltage shift, and the image is vividly displayed without influence of the common voltage.

The correction voltage corresponding to the image data is provided by the timing controller, and the compensation voltage is generated using the correction voltage. Therefore, the overcharge or overdischarge due to the common voltage shift is reduced, and the image quality of the display device is increased.

The power supply unit provides the compensation voltage to the panel using the correction voltage from the timing controller. Since the compensation voltage is selectively applied according to the state of the common voltage in the panel, the common voltage shift is reduced, and the quality of the image display in the display device is increased.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device comprising:

a panel displaying an image using image data and including a common electrode to which a common voltage is applied;

a timing controller providing the image data to the panel and outputting a correction voltage corresponding to the image data; and a power supply unit generating a compensation voltage using a panel common voltage and the correction voltage and providing the compensation voltage to the panel, wherein the panel common voltage is a voltage measuring the common voltage applied to the panel, wherein the power supply unit includes first, second, third and fourth resistors and first, second and third capacitors, and wherein the first capacitor and the first resistor are connected between the panel and an inverting input of an operational amplifier in series, the fourth resistor, the second capacitor and the third resistor are connected between the timing controller and the inverting input of the operational amplifier, the third capacitor is connected to ground and a point between the fourth resistor and the second capacitor, and the second resistor is connected between the inverting input of the operational amplifier and an output of the operational amplifier.

2. The device according to claim 1, wherein the power supply unit further includes:

the operational amplifier including the inverting input, a non-inverting input and the output; and a common voltage supply section connected to the non-inverting input.

3. The device according to claim 2, wherein the inverting input receives the panel common voltage and the correction voltage.

4. The device according to claim 2, wherein the third capacitor and the fourth resistor constitute a low pass filter, and the third capacitor and the fourth resistor are formed as one united body.

5. The device according to claim 1, wherein the correction voltage is outputted before a common voltage shift occurs in the panel common voltage.

6. A display device comprising:

a panel displaying an image using image data and including a common electrode to which a common voltage is applied;

a timing controller providing the image data to the panel and outputting a correction voltage corresponding to the image data; and a power supply unit generating a compensation voltage using a panel common voltage and the correction voltage and providing the compensation voltage to the panel, wherein the panel common voltage is a voltage measuring the common voltage applied to the panel, wherein the timing controller includes:

a gamma conversion part receiving the image data and outputting a gray level value;

a DC component computation part receiving the gray level value and outputting a DC component value;

a line gain adjustment part receiving the DC component value and outputting a magnitude of the compensation voltage; and a correction voltage generation part receiving the magnitude of the compensation voltage and outputting the correction voltage.

7. The device according to claim 6, wherein the timing controller includes storage parts connected to the gamma conversion part, the DC component part, and the line gain adjustment part, respectively, and wherein the storage parts provide lookup tables to the gamma conversion part, the DC component part and the line gain adjustment part, respectively.

* * * * *